US008573758B2

(12) United States Patent
Inoue et al.

(10) Patent No.: US 8,573,758 B2
(45) Date of Patent: Nov. 5, 2013

(54) LIQUID JET RECORDING HEAD AND LIQUID SUPPLY METHOD

(75) Inventors: Tomoyuki Inoue, Tokyo (JP); Ken Tsuchii, Sagamihara (JP); Masataka Sakurai, Kawasaki (JP); Yoshiyuki Nakagawa, Kawasaki (JP); Akiko Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 419 days.

(21) Appl. No.: 12/706,215

(22) Filed: Feb. 16, 2010

(65) Prior Publication Data

US 2010/0208010 A1 Aug. 19, 2010

(30) Foreign Application Priority Data

Feb. 17, 2009 (JP) ..... 2009-033894

(51) Int. Cl.

| | |
|---|---|
| ***B41J 2/175*** | (2006.01) |
| ***B41J 2/17*** | (2006.01) |
| ***B41J 2/18*** | (2006.01) |

(52) U.S. Cl.

USPC ..... 347/85; 347/84; 347/89

(58) Field of Classification Search

USPC ..... 347/84, 85, 89

See application file for complete search history.

(56) References Cited

U.S. PATENT DOCUMENTS 7,380,927 B2 * 6/2008 Shigemura ..... 347/85

FOREIGN PATENT DOCUMENTS

| | | |
|---|---|---|
| JP | 7-164640 | 6/1995 |
| JP | 2006-027108 A | 2/2006 |
| JP | 2007-168096 A | 7/2007 |
| JP | 2007-237475 A | 9/2007 |

* cited by examiner

*Primary Examiner* — Jannelle M Lebron

(74) *Attorney, Agent, or Firm* — Canon USA Inc IP Division

(57) ABSTRACT

A liquid jet recording head includes liquid discharge ports, pressure chambers, and a substrate which has the discharge energy generating element, a liquid chamber for storing a liquid supplied to the pressure chamber, a pair of paths which are separated from the liquid chamber, and a liquid supply port communicating with the liquid chamber. A liquid inlet port communicating with one path of the pair of paths and a liquid outlet port communicating with the other path of the pair of paths are opened on one surface of the substrate. A liquid flow path for discharging the liquid from the liquid chamber to the pressure chamber via the liquid supply port, and a liquid flow path for circulating the liquid from the one path to each pressure chamber via the liquid inlet port, and further from each pressure chamber to the other path via the liquid outlet port are provided.

7 Claims, 9 Drawing Sheets

LIQUID JET RECORDING HEAD AND LIQUID SUPPLY METHOD

BACKGROUND OF THE INVENTION

1. Field of the Invention

The present invention relates to a liquid jet recording head and a liquid supply method which are used in an ink jet recording apparatus.

2. Description of the Related Art

A recording head in an ink jet recording apparatus is configured to change an ink pressure in a pressure chamber provided on the recording head to discharge an ink droplet (a recording liquid droplet) from a discharge port, and perform recording by causing the discharged ink to adhere to a recording medium.

However, in the ink jet recording method which ejects the ink droplet according to the above described principle, when bubbles enter into the pressure chamber, unintended change of the ink pressure occurs, and a printing operation may become unstable. Thus, when bubbles enter into the recording head or bubbles are generated in the recording head, it is necessary to remove these bubbles.

When the recording head is left without any special protection such as a protection cap, color materials or solvents may condense due to water vaporization from a discharge port. As a result, ink viscosity increases, and may cause adverse effects on a discharging speed and a discharging direction. To avoid generation of residual bubbles and viscosity increase in the recording head which adversely affects a discharge performance, it is known that an ink circulation flow passing through the pressure chamber is effectively generated.

FIG. 9 illustrates a schematic configuration of an example of a main part of a conventional ink jet recording head in a horizontal cross section. In this configuration, the ink jet recording head includes a plurality of pressure chambers 44 which have discharge energy generation elements 43 arranged in a row, and ink chambers 45 provided on both sides of the pressure chambers 44. The ink chambers 45 are configured to store an ink to be supplied to the pressure chambers 44. Further, the ink jet recording head includes an ink inlet port 40 which communicates with one ink chamber 45, and an ink outlet port 41 which communicates with another ink chamber 45. Furthermore, a partition wall 42 for forming the pressure chambers 44 is provided in the ink jet recording head.

When ink is discharged from the pressure chambers 44, the ink is supplied from the ink chambers 45 located on both sides of the pressure chambers 44, to the pressure chambers 44. When the ink jet recording head removes bubbles generated in the pressure chambers 44, ink is introduced from the ink inlet port 40, and then discharged from the ink outlet port 41. Consequently, an ink circulation flow 46 is formed in which the ink flows through a route including the ink inlet port 40, the ink chamber 45, the pressure chambers 44, the ink chamber 45, and the ink outlet port 41. The ink circulation flow 46 can remove the bubbles in the pressure chambers 44. (Refer to Japanese Patent Application Laid-Open No. 07-164640)

The ink circulation flow 46 flowing from the ink inlet port 40 to the ink outlet port 41 is a linear flow in the pressure chambers 44. Thus, in the pressure chambers 44 which are in the vicinity of a straight line connecting the ink inlet port 40 and the ink outlet port 41, the ink circulation flow 46 passing therethrough can be easily generated. However, in the pressure chambers 44 which are distantly positioned from the straight line connecting the ink inlet port 40 and the ink outlet port 41, the ink circulation flow 46 passing therethrough is hardly generated.

Therefore, in order to generate the ink circulation flow 46 in all pressure chambers 44, the ink chambers 45 is made large so that the ink inlet port 40 and the ink outlet port 41 may be located far from the pressure chambers 44. Further, the partition walls 42 forming the pressure chambers 44 are made long. By taking such a configuration, it is necessary that a flow path connecting the ink inlet port 40, the ink outlet port 41, and the pressure chambers 44 becomes a straight line as much as possible. In this way, the flow path of the ink circulation flow 46 is formed to allow the ink to easily flow from the ink inlet port 40 into each pressure chamber 44. Such configuration makes it difficult to reduce a size of the ink jet recording head.

When nozzle resolution is increased by forming multiple rows of the pressure chambers and integrating nozzles, the ink inlet port 40 and the ink outlet port 41 are alternately arranged so as to sandwich each row of the pressure chambers between the ink inlet port 40 and the ink outlet port 41. In order to generate the ink circulation flow 46 passing through each pressure chamber 44, directionality of the ink circulation flow 46 needs to be improved and it is necessary to provide a thicker partition wall 42 than a case of a single row in the pressure chamber 44.

Further, when the multiple rows of the pressure chambers 44 are provided, it is necessary to place the pressure chambers in a staggered arrangement, that is, each pressure chamber 44 is not arranged in the same position in a column direction, and a pressure chamber 44 in one row is positioned between pressure chambers 44 in another row. Therefore, when the pressure chambers 44 are formed in the multiple rows, it is difficult to downsize the ink jet recording head.

SUMMARY OF THE INVENTION

The present invention is directed to an ink jet recording head and a liquid supply method which can generate an ink circulation flow and can be downsized.

According to an aspect of the present invention, a liquid jet recording head includes a plurality of liquid discharge ports for discharging a liquid, a plurality of pressure chambers which internally include a discharge energy generating element configured to generate energy used for discharging the liquid, and a substrate which has the discharge energy generating element on one surface side and, on another surface side, has a liquid chamber configured to store a liquid to be supplied to the pressure chamber, a pair of paths which are separated from the liquid chamber and communicate with each other, and a liquid supply port which communicates with the liquid chamber and is provided on a side of the pressure chamber, wherein a liquid inlet port which communicates with the one path of the pair of paths, and a liquid outlet port which communicates with the other path of the pair of paths are opened on the one surface of the substrate, wherein a liquid flow path for discharging the liquid from the liquid chamber to the pressure chamber via the liquid supply port, and a liquid flow path for circulating the liquid from the one path to each of the pressure chambers via the liquid inlet port, and further circulating the liquid from each of the pressure chambers to the other path via the liquid outlet port are provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 1A is a schematic diagram illustrating a horizontal cross section. FIG. 1B is a schematic diagram illustrating a cross section taken along a line B-B' in FIG. 1A. FIG. 1C is a schematic diagram illustrating a cross section taken along a line C-C' in FIG. 1A.

FIG. 2A is a schematic diagram illustrating a horizontal cross section. FIG. 2B is a schematic diagram illustrating a cross section taken along a line B-B' in FIG. 2A. FIG. 2C is a schematic diagram illustrating a cross section taken along a line C-C' in FIG. 2A.

FIG. 3A is a schematic diagram illustrating a horizontal cross section. FIG. 3B is a schematic diagram illustrating a cross section taken along a line B-B' in FIG. 3A. FIG. 3C is a schematic diagram illustrating a cross section taken along a line C-C' in FIG. 3A.

FIG. 4A is a schematic diagram illustrating a horizontal cross section. FIG. 4B is a schematic diagram illustrating a cross section taken along a line B-B' in FIG. 4A. FIG. 4C is a schematic diagram illustrating a cross section taken along a line C-C' in FIG. 4A.

FIG. 5A is a schematic diagram illustrating a horizontal cross section. FIG. 5B is a schematic diagram illustrating a cross section taken along a line B-B' in FIG. 5A.

FIG. 6A is a schematic diagram illustrating a horizontal cross section. FIG. 6B is a schematic diagram illustrating a cross section taken along a line B-B' in FIG. 6A. FIG. 6C is a schematic diagram illustrating a cross section taken along a line C-C' in FIG. 6A.

DESCRIPTION OF THE EMBODIMENTS

Various exemplary embodiments, features, and aspects of the invention will be described in detail below with reference to the drawings.

The same functional configurations in the attached drawings are defined with the same numerals, and descriptions thereof are not repeated.

Figure 1A:
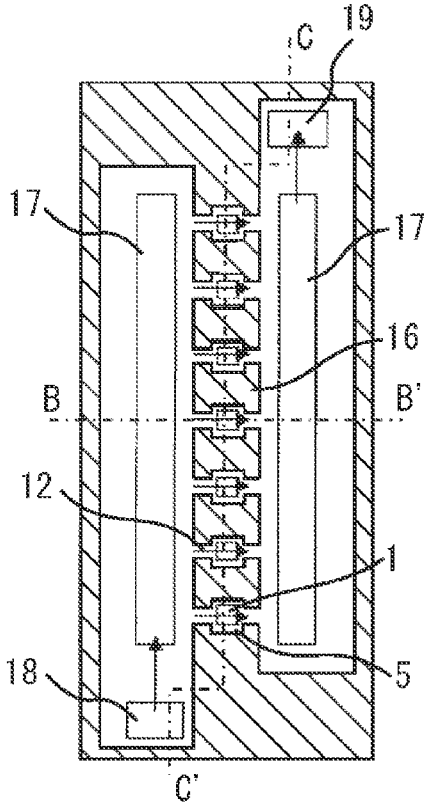
FIGS. 1A to 1C are schematic configuration diagrams illustrating a main part of a first exemplary embodiment of an ink jet recording head according to the present invention.
Figure 1B:
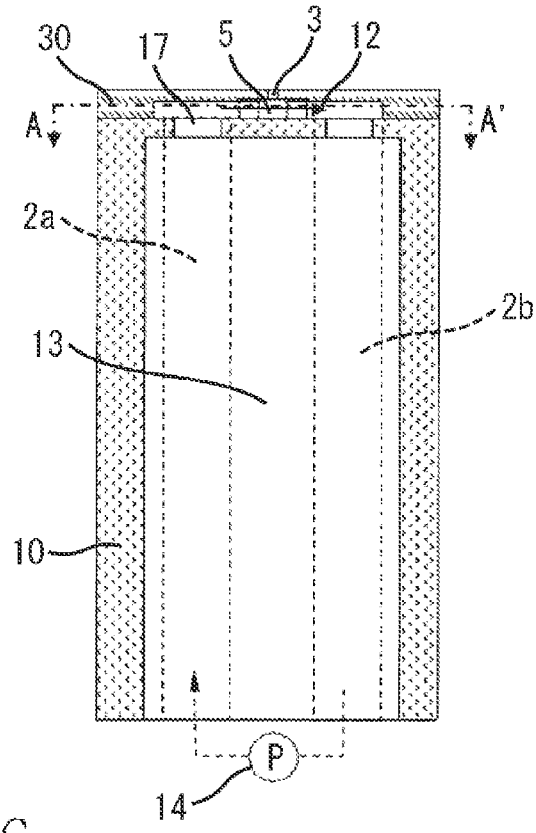
Figure 1C:
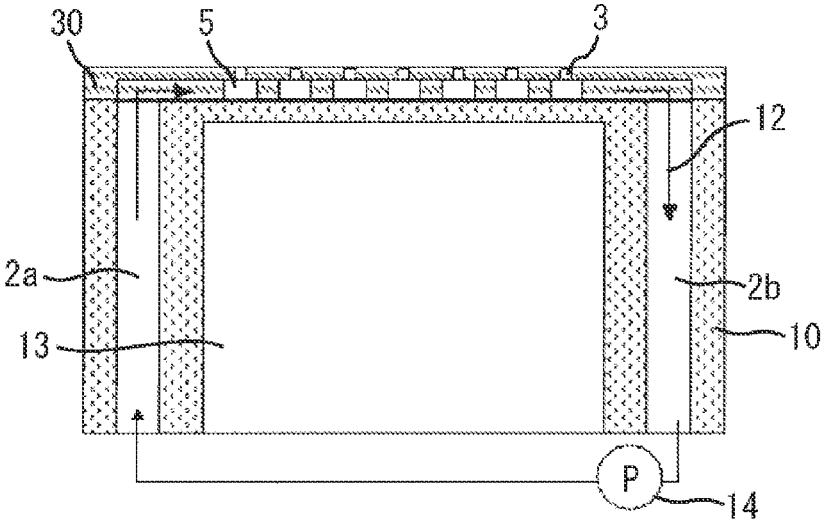

A first exemplary embodiment of a liquid jet recording head (an ink jet recording head) according to the present invention will be described with reference to FIGS. 1A to 1C. FIGS. 1A to 1C are schematic configuration diagrams illustrating a main part of the first exemplary embodiment of the ink jet recording head according to the present invention. FIG. 1A is a schematic diagram illustrating a horizontal cross section (taken along a line A-A' in FIG. 1B. FIG. 1B is a schematic diagram illustrating a cross section taken along a line B-B' in FIG. 1A. FIG. 1C is a schematic diagram illustrating a cross section taken along a line C-C' in FIG. 1A.

The ink jet recording head includes a substrate 10 and a discharge port plate 30. The substrate 10 includes a liquid chamber (ink chamber) 13 configured to internally store an ink, and a pair of paths 2*a* and 2*b* which are separated from the ink chamber 13 and configure a part of an ink circulation path for circulating a liquid (ink). Further, the substrate 10 includes an ink supply port 17 communicating with the ink chamber 13. The discharge port plate 30 includes an ink discharge port 3 and a partition wall 16. The ink discharge port 3 penetrates the discharge port plate 30 in its thickness direction, and is configured to discharge ink expanded by a discharge energy generating element 1 which is provided in a pressure chamber 5. The partition wall 16 is provided for forming the pressure chamber 5.

A surface of the substrate 10 which is in contact with the discharge port plate 30 will be described in detail below. The discharge energy generating element 1 for heating ink when the ink is discharged is provided at a position corresponding to an inside of the pressure chamber 5. A plurality of the pressure chambers 5 is regularly arranged in a straight line so as to be one row. Further, ink supply ports 17 with a slit shape (like a long hole) extend along the row of the pressure chambers 5 and are opened so as to sandwich the row of the pressure chambers 5 therebetween. Only one pair of an ink inlet port 18 and an ink outlet port 19 is provided at a pair of diagonal corners on the surface of the substrate 10 which is in contact with the discharge port plate 30. The inlet port 18 allows ink to flow in from the path 2*a*, and the ink outlet port 19 lets the ink flow out to the other path 2*b*. The ink inlet port 18 connects to the path 2*a* in the substrate 10, and the ink outlet port 19 connects to the other path 2*b* in the substrate 10. The path 2*a* connecting to the ink inlet port 18 and the other path 2*b* connecting to the ink outlet port 19 are connected with each other via a pressure control unit 14, such as a pump, which is provided outside the substrate 10. The paths 2*a* and 2*b* form an ink circulation path for circulating ink.

The ink supply port 17 has a function of replenishing ink which is discharged from the pressure chambers 5 and consumed from the ink chamber 13 to the pressure chambers 5.

When ink is discharged from the pressure chambers 5, the ink is supplied from the ink chamber 13 to each pressure chamber 5 via the ink supply port 17 provided on the both sides of the pressure chambers 5. When bubbles generated in the pressure chambers 5 are removed, ink is not supplied from the ink supply port 17, but is introduced from the ink inlet port 18 by the pressure control unit 14, and is discharged from the ink outlet port 19. Accordingly, an ink circulation flow 12 is generated which flows a route from the path 2*a* to each pressure chamber 5 via the ink inlet port 18, and further flows from each pressure chamber 5 to the other path 2*b* via the ink outlet port 19. Since the ink inlet port 18 and the ink outlet port 19 are arranged at an angle to an ink moving direction in the pressure chamber 5, ink can uniformly pass through any pressure chambers 5. Further, ink in the pressure chamber 5 near the ink inlet port 18 is easily pushed out, and ink in the pressure chamber near the ink outlet port 19 is easily suctioned. Therefore, ink movement occurs in all of the pressure chambers 5, and the ink circulation flow 12 passing all of the pressure chambers 5 is generated and cleans the inside of the pressure chambers 5.

The above described method can reduce a conventional phenomenon that an ink circulation flow 45 largely occurs in the specific pressure chambers 44 (pressure chambers located on the center). Further, according to the above described method, the partition walls 16 can be comparatively short and thin. Furthermore, it is not necessary to arrange the ink inlet port 18 and the ink outlet port 19 fully apart from the both sides of the pressure chambers 5. Therefore, a large-size head unit is not necessary, and the size of the ink jet recording head can be reduced.

A modified exemplary embodiment of the configuration illustrated in FIG. 1 will be described below.

Figure 2A:
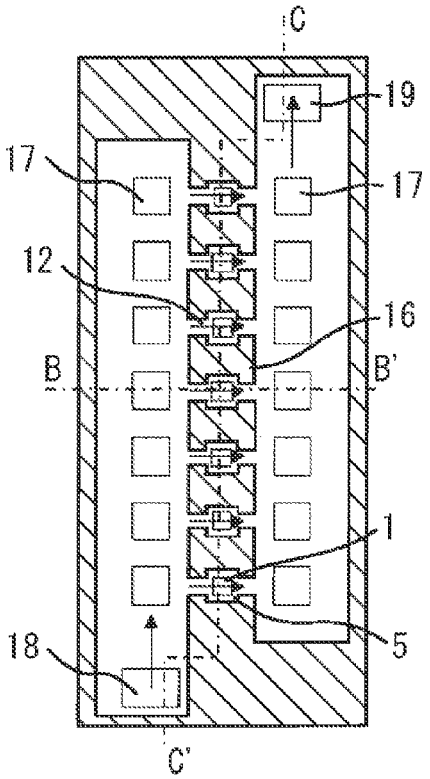
FIGS. 2A to 2C are schematic configuration diagrams of a main part of a modified exemplary embodiment of the ink jet recording head illustrated in FIGS. 1A to 1C.
Figure 2B:
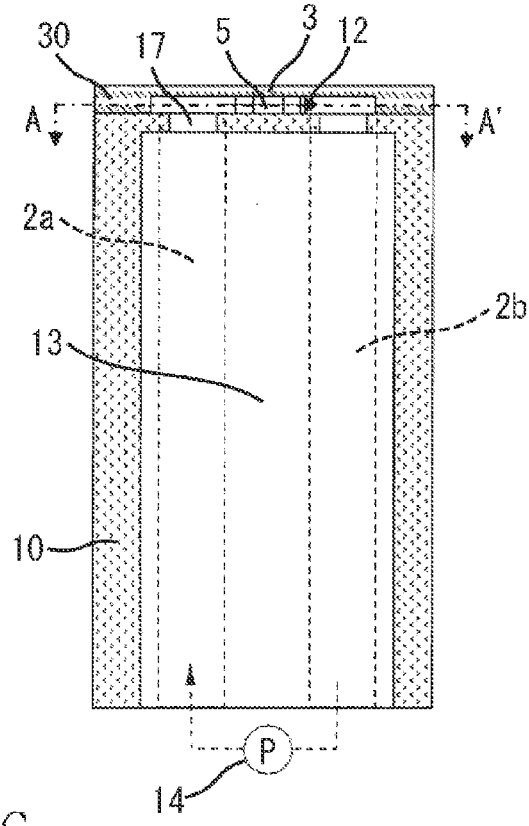
Figure 2C:
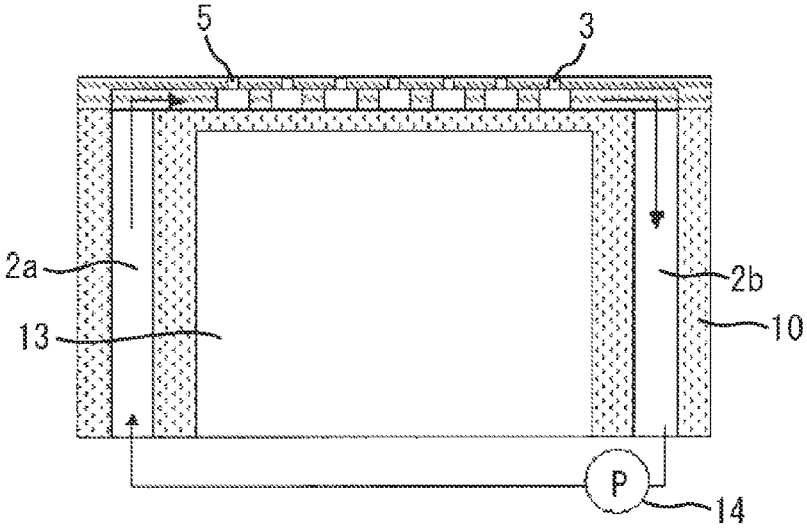

FIGS. 2A to 2C are schematic configuration diagrams of a main part illustrating a state in which the slit shaped ink supply port 17 provided at the head unit of the ink jet recording head illustrated in FIGS. 1A to 1C is divided into a plurality of holes located at positions corresponding to each pressure chamber 5. FIG. 2A is a schematic diagram illustrating a horizontal cross section (taken along a line A-A' in FIG. 2B). FIG. 2B is a schematic diagram illustrating a cross section taken along a line B-B' in FIG. 2A. FIG. 2C is a schematic diagram illustrating a cross section taken along a line C-C' in FIG. 2A. The configuration illustrated in FIGS. 2A to 2C is similar to the configuration illustrated in FIGS. 1A to 1C other than that the slit shaped ink supply port 17 in FIGS. 1A to 1C is divided into a plurality of holes. If the ink jet recording head is configured to not have the slit shaped ink supply port 17 illustrated in FIGS. 1A to 1C, but have a plurality of hole shaped ink supply ports 17 on the both sides of each pressure chamber 5 as illustrated in FIGS. 2A to 2C, the ink jet recording head can acquire similar effects.

Figure 3A:
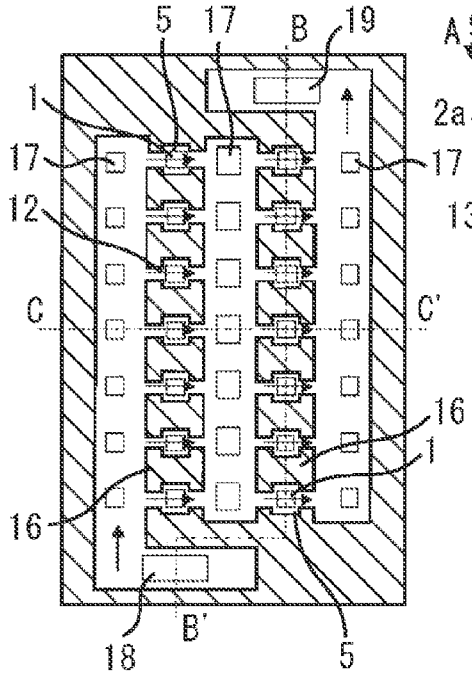
FIGS. 3A to 3C are schematic configuration diagrams of a main part of another modified exemplary embodiment of the ink jet recording head illustrated in FIG. 1.
Figure 3B:
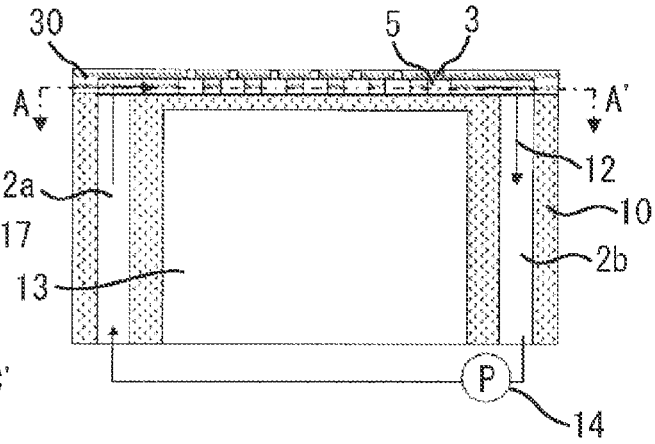
Figure 3C:
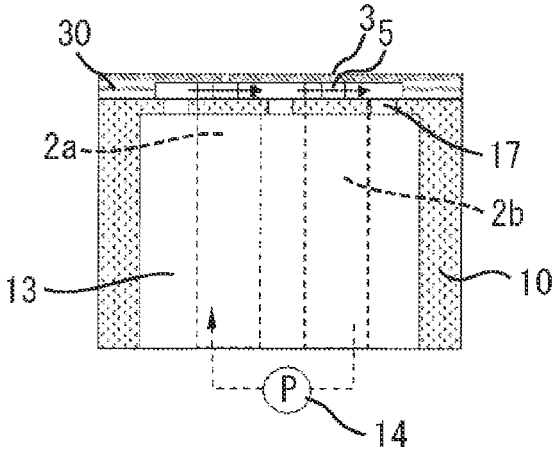

FIGS. 3A to 3C are schematic diagrams of a main part which illustrates a state that a row of the pressure chambers 5 of the ink jet recording head illustrated in FIGS. 1A to 1C is increased to multiple rows. FIG. 3A is a schematic diagram illustrating a horizontal cross section (taken along the line A-A' in FIG. 3B). FIG. 3B is a schematic diagram illustrating a cross section taken along a line B-B' in FIG. 3A. FIG. 3C is a schematic diagram illustrating a cross section taken along a line C-C' in FIG. 3A. The configuration illustrated in FIGS. 3A to 3C is similar to the configuration illustrated in FIGS. 1A to 1C other than that the row of the pressure chambers 5 is increased to the multiple rows.

In this configuration, the ink supply ports 17 are provided on both sides of each row of the pressure chambers 5. When ink is discharged from the pressure chambers 5, the ink is supplied from the ink chamber 13 to each pressure chamber 5 via the ink supply ports 17 on the both sides of the pressure chambers 5.

When bubbles generated in the pressure chambers 5 are removed, an ink circulation flow 12 is generated. The ink circulation flow 12 flows a route from the path 2*a* to each pressure chamber 5 via the ink inlet port 18, and further flows from each pressure chamber 5 to the other path 2*b* via the ink outlet port 19. Accordingly, based on the above described reason, the ink circulation flow 12 passing all of the pressure chambers 5 is generated and cleans the inside of the pressure chambers 5.

According to the above configuration, if the multiple rows of the pressure chambers 5 are formed, the ink circulation flow 12 can be generated in each pressure chamber 5. Further, it is not necessary to thicken and extend the partition wall 16, and the multiple rows of the pressure chambers 5 can be formed without increasing the size of the head unit.

In the configuration illustrated in FIGS. 3A to 3C, a plurality of independent holes is provided as the ink supply port 17 on the both sides of each pressure chamber 5, similar to the configuration illustrated in FIGS. 2A to 2C. However, the ink supply port 17 can be formed in a long slit shape similar to the configuration illustrated in FIGS. 1A to 1C.

A second exemplary embodiment of the present invention will be described below with reference to FIGS. 4A to 4C and FIGS. 5A and 5B.

Figure 4A:
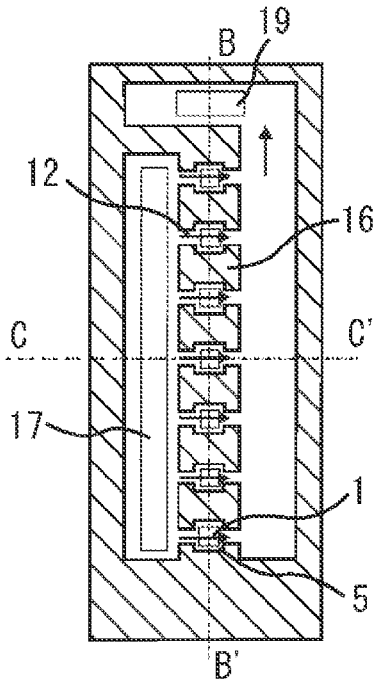
FIGS. 4A to 4C are schematic configuration diagrams illustrating a main part of a second exemplary embodiment of an ink jet recording head according to the present invention.
Figure 4B:
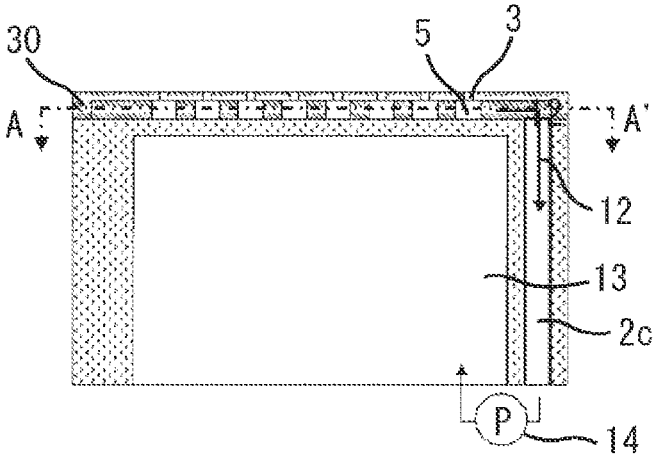
Figure 4C:
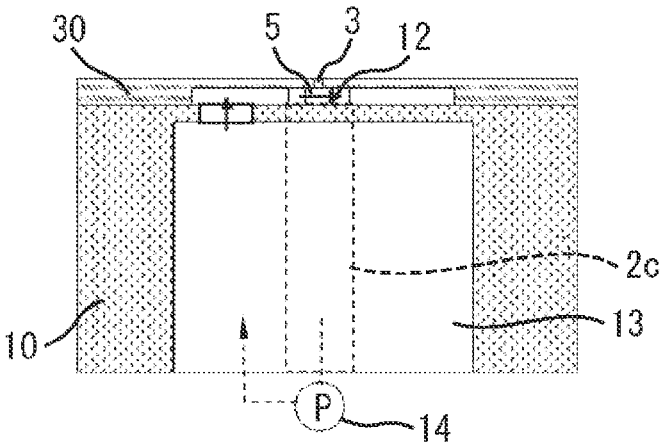

FIGS. 4A to 4C are schematic configuration diagrams illustrating a main part of an ink jet recording head of the second exemplary embodiment. FIG. 4A is a schematic diagram illustrating a horizontal cross section (taken along a line A-A' in FIG. 4B). FIG. 4B is a schematic diagram illustrating a cross section taken along a line B-B' in FIG. 4A. FIG. 4C is a schematic diagram illustrating a cross section taken along a line C-C' in FIG. 4A. Only configurations different from the first exemplary embodiment will be described, and descriptions of the configurations similar to the first exemplary embodiment will be omitted.

The substrate 10 is different from the above described first exemplary embodiment and includes one path 2*c* which configures a part of an ink circulation path for circulating ink inside thereof.

The surface of the substrate 10 which is in contact with the discharge port plate 30 will be described in detail below. The pressure chambers 5 are linearly arranged so as to form one row. Unlike the first exemplary embodiment described using FIGS. 1A to 1C, the slit shape (a long hole) ink supply port 17 is opened only on one side of the row of the pressure chambers 5. The slit shaped ink supply port 17 has a length which is approximately equal to a length of an array of the discharge energy generating elements 1. Further, in order to allow ink to flow from the ink supply port 17 via the ink chamber 13 to an opposite side of the ink supply port 17 across the row of the pressure chambers 5, only one ink outlet port 19 for flowing out the ink to the ink path 2*c* is provided on a longitudinal edge portion side of the substrate 10 further than the row of the pressure chambers 5.

The path 2*c* in the substrate 10 connected to the ink outlet port 19 is connected with the ink chamber 13 via the pressure control unit 14, such as a pump, provided outside the substrate 10. The ink circulation path for circulating ink from the ink outlet port 19 to the ink supply port 17 via the path 2*c* and the ink chamber 13 is formed.

The ink supply port 17 has not only a function of replenishing ink which is discharged from the pressure chambers 5 and consumed from the ink chamber 13 to the pressure chambers 5, but also a function of supplying ink required to generate the ink circulation flow 12.

When ink is discharged from the pressure chambers 5, the ink is supplied from the ink chamber 13 to each pressure chamber 5 via the ink supply port 17 provided on one side of the pressure chambers 5.

When bubbles generated in the pressure chambers 5 are removed, ink is introduced from the ink supply port 17 by the pressure control unit 14, and is discharged from the ink outlet port 19. Accordingly, an ink circulation flow 12 is generated which flows a route from the ink chamber 13 via the ink supply port 17 to each pressure chamber 5, and further flows from each pressure chamber 5 to the path 2*c* via the ink outlet port 19. Therefore, the ink circulation flow 12 can clean the inside of the pressure chambers 5 based on the above described reason.

Since ink pushed out from the ink chamber 13 by the pressure control unit 14 approximately uniformly comes out from the ink supply port 17, the ink flows through all of the pressure chambers 5 to the ink outlet port 19. Therefore, it can be reduced a phenomenon that the ink circulation flow 12 largely occurs in the specific pressure chamber 5.

Further, in the configuration illustrated in FIGS. 4A to 4C, even if the ink circulation flow 12 is generated, the recording head can constantly supply ink of uniform composition from the ink supply port 17 which is opened near the pressure chambers 5. Thus, the configuration has high stability of discharging performance. Therefore, the present exemplary embodiment can reduce generation of color unevenness more than the first exemplary embodiment. The color unevenness occurs due to differences of discharge speed and discharge amount among a plurality of pressure chambers 5, or a difference of density of color material of a discharged droplet.

Figure 5A:
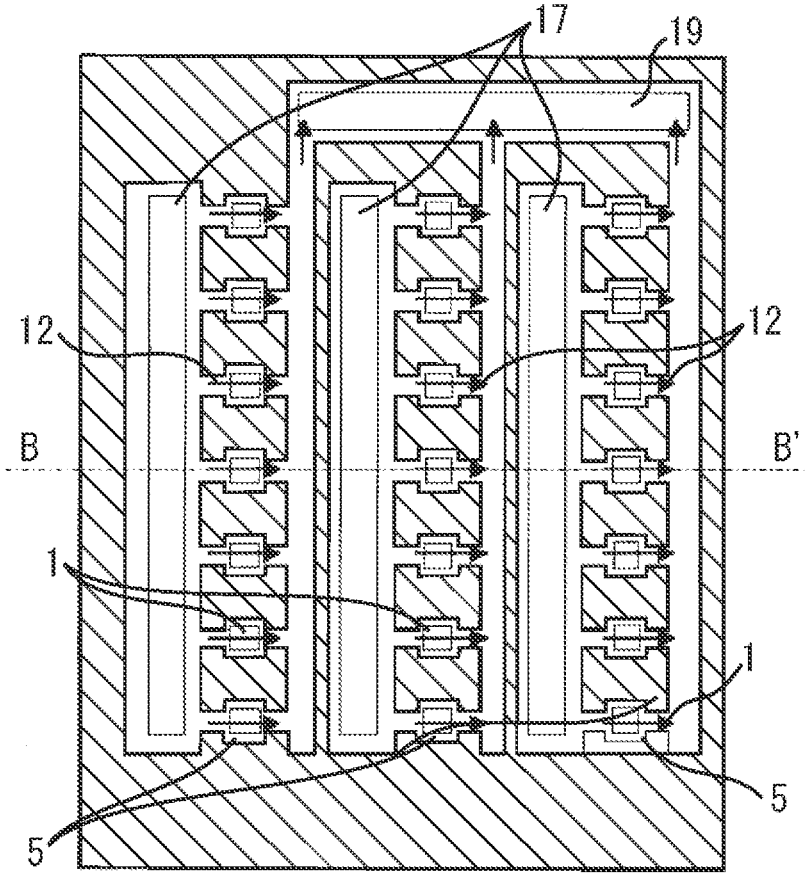
FIGS. 5A and 5B are schematic configuration diagrams of a main part of a modified exemplary embodiment of the ink jet recording head illustrated in FIG. 4.
Figure 5B:
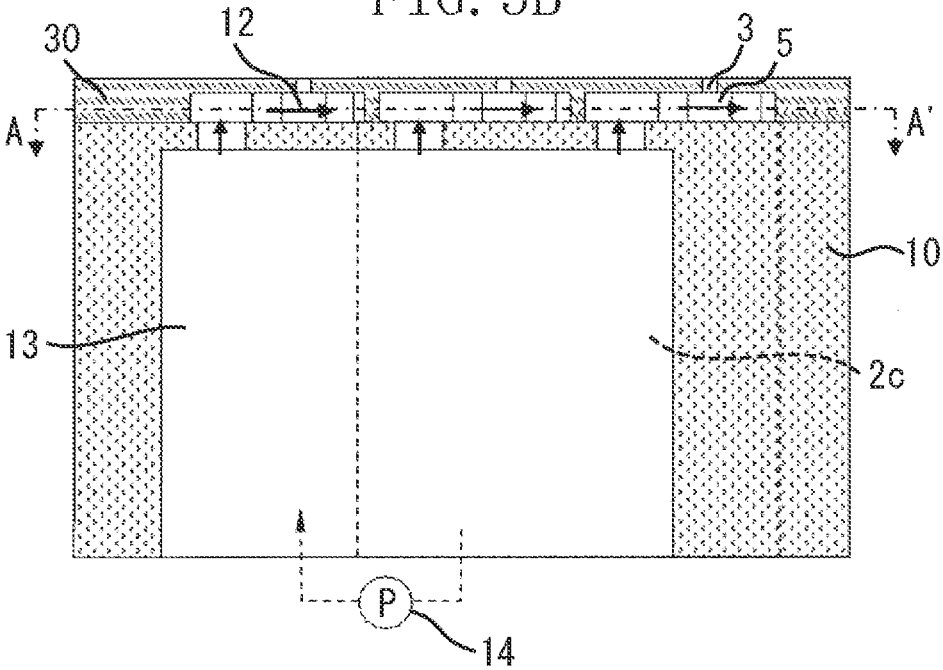

The above described second exemplary embodiment is configured to have one row of the pressure chambers 5, but can be configured to have multiple rows of the pressure chambers 5. FIGS. 5A and 5B are schematic diagrams illustrating a main part of the ink jet recording head in which the multiple rows of the pressure chambers 5 are formed. FIG. 5A is a schematic diagram illustrating a horizontal cross section (taken along a line A-A' in FIG. 5B). FIG. 5B is a schematic diagram illustrating a cross section taken along a line B-B' in FIG. 5A.

In this configuration, one row of the pressure chambers 5 linearly arranged in FIG. 4A and the ink supply port 17 are arranged as a pair and a plurality of the pairs is arranged in parallel. The ink supply ports 17 are located on one side of each pressure chamber 5 arranged in a plurality of rows. One common ink outlet port 19 is provided at an end of an opposite side of the ink supply port 17 across the row of the pressure chambers 5. The configurations other than the described above are similar to the configurations illustrated in FIGS. 4A to 4C.

In this configuration, even if the multiple rows of the pressure chambers 5 are formed, the ink outlet port 19 can be commonly used, so that it is not necessary to provide a plurality of the ink outlet ports 19. Therefore, if the multiple rows of the pressure chamber 5 are formed, the size of the head unit does not increase, and the structure thereof is not largely complicated by them.

In the second exemplary embodiment, the ink supply port 17 is formed in a slit shape extending along the row of the pressure chambers 5. However, the ink supply port 17 can be divided into a plurality of holes at a position corresponding to each pressure chamber 5.

A third exemplary embodiment of the present invention will be described below with reference to FIGS. 6A to 6C.

Figure 6A:
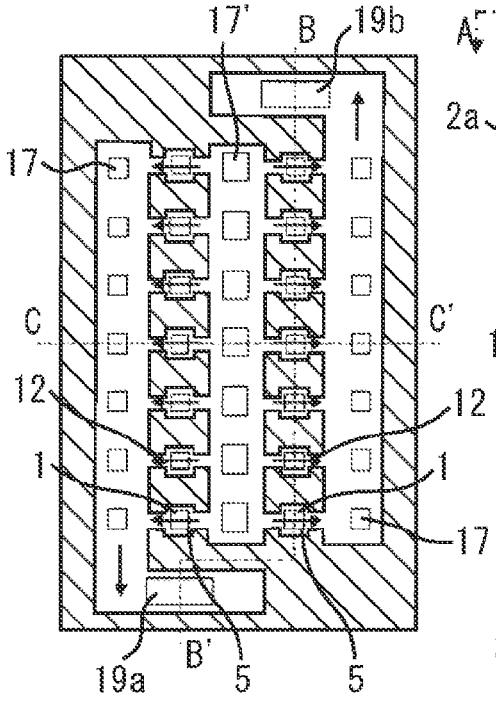
FIGS. 6A to 6C are schematic configuration diagrams illustrating a main part of a third exemplary embodiment of an ink jet recording head according to the present invention.
Figure 6B:
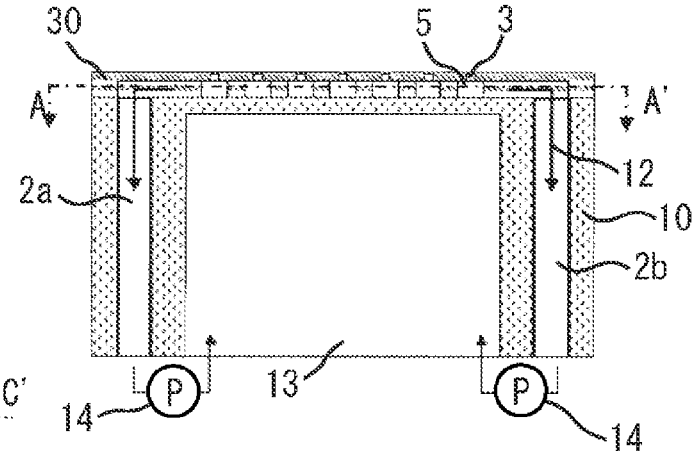
Figure 6C:
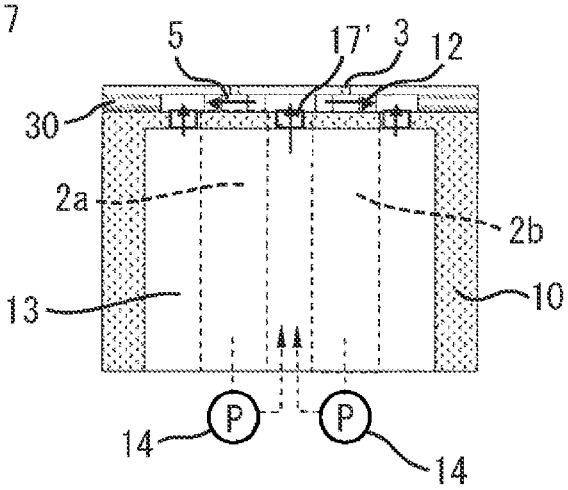

FIGS. 6A to 6C are schematic configuration diagrams illustrating a main part of the third exemplary embodiment of an ink jet recording head. FIG. 6A is a schematic diagram illustrating a horizontal cross section (taken along a line A-A' in FIG. 6B). FIG. 6B is a schematic diagram illustrating a cross section taken along a line B-B' in FIG. 6A. FIG. 6C is a schematic diagram illustrating a cross section taken along a line C-C' in FIG. 6A. Only configurations different from the first exemplary embodiment will be described, and descriptions of the configurations similar to the first exemplary embodiment will be omitted.

The substrate 10 includes a pair of paths 2*a* and 2*b* which configure a part of an ink circulation path for circulating ink.

The surface of the substrate 10 which is in contact with the discharge port plate 30 will be described in detail below. The ink supply ports 17 which do not have a slit shape (like a long hole) but have a plurality of holes divided in every positions corresponding to each pressure chamber 5 are provided on both sides of the pressure chambers 5 linearly arranged in two rows. Further, only one pair of ink outlet ports 19*a* and 19*b* is provided at a pair of diagonal corners on the surface of the substrate 10 which is in contact with the discharge port plate 30. The ink outlet ports 19*a* and 19*b* flow out ink to the paths 2*a* and 2*b*.

One path 2*a* in the substrate 10 connected to one ink outlet port 19*a* is connected with the ink chamber 13 via the pressure control unit 14, such as a pump, provided outside the substrate 10. Similarly, another path 2*b* in the substrate 10 connected to another ink outlet port 19*b* is connected with the ink chamber 13 via the pressure control unit 14, such as a pump, provided outside the substrate 10. Therefore, the ink circulation path for circulating ink is configured, in which ink flows from the ink outlet ports 19*a* and 19*b* to the ink supply ports 17 via the paths 2*a* and 2*b* and the ink chamber 13.

The ink supply port 17 has not only a function of replenishing ink which is discharged from the pressure chambers 5 and consumed from the ink chamber 13 to the pressure chambers 5, but also a function of supplying ink required to generate the ink circulation flow 12.

In the third exemplary embodiment, an opening area of each of the ink supply ports 17 is changed according to the positions of the row. More specifically, opening areas of ink supply ports 17' which are sandwiched between the rows of the pressure chambers 5 are made larger than the opening areas of the ink supply ports 17 which are not sandwiched between the rows of the pressure chambers 5. Accordingly, more ink can flow into the pressure chamber from the ink supply port 17' than from the ink supply port 17 which is not sandwiched between the rows of the pressure chambers 5. Therefore, ink flows from the row of the ink supply ports 17' sandwiched between the rows of the pressure chambers 5 to the rows of the pressure chambers 5 of both sides thereof, and the ink circulation flow 12 can be generated.

When ink is discharged from the pressure chambers 5, the ink is supplied from the ink chamber 13 to each pressure chamber 5 via the ink supply ports 17 and 17' provided on the both sides of the pressure chambers 5.

When bubbles generated in the pressure chambers 5 are removed, ink from the ink chamber 13 is introduced from the ink supply port 17' which is sandwiched between the rows of the pressure chambers 5 by the pressure control unit 14, and is discharged from the ink outlet ports 19*a* and 19*b*. Accordingly, the ink circulation flow 12 is generated which flows a route (ink circulation path) from the ink chamber 13 to each pressure chamber 5 of one row of the pressure chambers 5 via the ink supply port 17', and further flows from each pressure chamber 5 of one row of the pressure chambers 5 to the one path 2*a* via the one ink outlet port 19*a*. At the same time, the ink circulation flow 12 is generated which flows a route (ink circulation path) from the ink chamber 13 to each pressure chamber 5 of another row of the pressure chambers 5 via the ink supply port 17', and further flows from each pressure chamber 5 of another row of the pressure chambers 5 to another path 2*b* via another ink outlet port 19*b*. Therefore, the ink circulation flows 12 can clean insides of all of the pressure chambers 5. In addition, since the pressure control unit 14 is used, ink flowing in from the ink supply ports 17 which are not sandwiched between the rows of the pressure chambers 5 flows to the ink outlet ports 19*a* and 19*b*.

Since the ink pushed out from the ink chamber 13 by the pressure control unit 14 approximately uniformly comes out from the ink supply ports 17' which are sandwiched between the rows of the pressure chambers 5, it can be reduced a phenomenon that the ink circulation flow 12 largely occurs in the specific pressure chamber 5. Therefore, it is not necessary to thicken and extend the partition walls 16, and the size of the head can be miniaturized.

Even if the ink circulation flow 12 is generated, the recording head can constantly supply ink of uniform composition from the ink supply ports 17 and 17' which are opened near the pressure chambers 5. Thus, the configuration has high stability of discharging performance. Therefore, the present exemplary embodiment can reduce generation of color unevenness more than the first exemplary embodiment. The color unevenness occurs due to differences of discharge speed and discharge amount among a plurality of pressure chambers 5, or a difference of density of color material of a discharged droplet.

The third exemplary embodiment will be described in detail below.

The row of the ink supply ports 17' sandwiched between the rows of the pressure chambers 5 is formed to have a square opening of 30 μm of each side. The rows of the ink supply ports 17 on both sides which are not sandwiched between the rows of the pressure chambers 5 are formed to have a square opening of 20 μm of each side. A path connecting the ink supply ports 17 and the ink chamber 13 in the substrate 10 has a similar shape.

In general, fluid resistance is inversely proportional to square of a cross section area of a flow path in which a liquid flows. Thus, resistance of the ink circulation flow 12 circulating from the ink supply ports 17' at the center is about ⅕ of the resistance of the ink circulation flow 12 circulating from the ink supply ports 17 on the both sides. Since a large amount of ink easily flows in from the ink supply ports 17' at the center, it is possible to generate the ink circulation flow 12 flowing from the ink supply port 17' at the center to the ink outlet port 19 via the pressure chambers 5.

The ink circulation flow 12 was generated in the ink jet recording head using the pressure control unit 14 provided outside the substrate 10. As a result, it was found that the ink circulation flow 12 at a flow rate of about 2 mm/s can be generated in the pressure chambers 5 by calculation of a numerical processing computer. If the ink circulation flow 12 at the flow rate of about 2 mm/s is generated, bubbles in and around the pressure chambers 5 can be easily removed and cleaning can be performed. Further, since the ink circulation flow 12 can remove the bubbles in the pressure chamber 5, it is not necessary to perform a suction recovery processing for removing bubbles in the pressure chamber 5 using an outside mechanism. Furthermore, since preliminary discharging is not necessary, an amount of waste ink by preliminary discharging can be reduced.

If ink flows in from the ink inlet port 19 and flows out from the ink supply ports 17' sandwiched between the rows of the pressure chambers 5, the similar effects can be acquired.

A fourth exemplary embodiment of the present invention will be described below with reference to FIG. 7.

Figure 7:
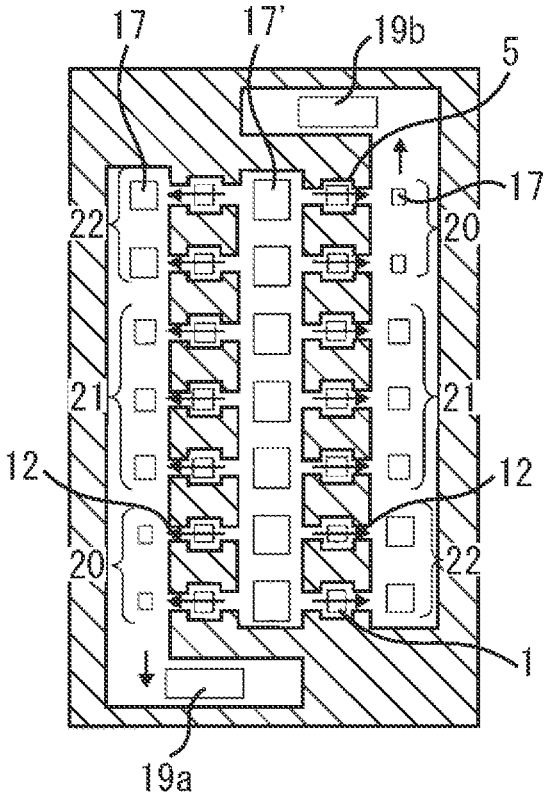
FIG. 7 is a schematic diagram illustrating a horizontal cross section of a main part of a fourth exemplary embodiment of an ink jet recording head according to the present invention.

FIG. 7 is a schematic configuration diagram illustrating a main part of an ink jet recording head of the fourth exemplary embodiment according to the present invention. Since a fundamental structure illustrated in FIG. 7 is almost similar to the above described third exemplary embodiment, detailed description thereof will be omitted, and only different points will be described.

As illustrated in FIG. 7, the configuration of the forth exemplary embodiment includes the pressure chambers 5 which are linearly arranged in two rows and hole shaped ink supply ports 17 which are provided on both sides of the rows of the pressure chambers 5 at a position corresponding to each pressure chamber 5. Opening shapes of the ink supply ports 17 are different according to a position of the row of the ink supply ports 17 and a position in the row thereof. An opening area of the row of the ink supply ports 17' which is sandwiched between the rows of the pressure chambers 5 is made lager than that of the rows of the ink supply ports 17 which are not sandwiched between the rows of the pressure chambers 5. Further, in the row of the ink supply ports 17 which is not sandwiched between the rows of the pressure chambers 5, the opening area of the ink supply port 17 is made small near the ink outlet port 19 and to become larger with increasing distance from the ink outlet port 19. The other configurations of the fourth exemplary embodiment are similar to that of the third exemplary embodiment (illustrated in FIGS. 6A to 6C). By changing the opening areas of the ink supply ports 17, an inflow amount of ink changes according to the positions of the ink supply ports 17. More specifically, resistance of the ink circulation flow 12 becomes different, so that flow rates of the ink circulation flows 12 according to the difference of the positions of the pressure chambers 5 can be approximated to a uniform rate.

The opening shapes of the ink supply ports 17 of the fourth exemplary embodiment will be described in more detail by using the following examples.

The pressure chambers 5 are arranged in two rows at pitches of 600 dots per inch (dpi). Three rows of the ink supply ports 17 and 17' are arranged so as to sandwich these rows of the pressure chambers 5 therebetween. Opening shapes of the ink supply ports 17' which are sandwiched between the rows of the pressure chambers 5 are formed in a square of 30 μm of each side. Opening shapes of the ink supply ports 17 which are not sandwiched between the rows of the pressure chambers 5 are formed in a square that has a different size according to the position in the row of the ink supply ports 17. The opening areas gradually changes from a 15 μm square to a 25 μm square in order of increasing distance from the ink outlet port 19. More specifically, an ink supply port group 20 near the ink outlet port 19 has an opening shape of 15 μm square. An ink supply port group 22 apart from the ink outlet port 19 has an opening shape of 25 μm square. An ink supply port group 21 between the groups 20 and 22 has an opening shape of 20 μm square. According to such a configuration, since an ink flow from the ink supply ports 22 to the ink outlet ports 19*a* and 19*b* is generated, the ink circulation flow 12 which flows in the pressure chambers 5 apart from the ink outlet ports 19*a* and 19*b* is pulled by this flow and its flow rate is increased. Therefore, the flow rate of the ink circulation flow 12 can be uniformed in both pressure chambers 5 near the ink outlet ports 19*a* and 19*b* and the pressure chambers 5 far from the ink outlet ports 19*a* and 19*b*.

If the difference of the resistances of the ink circulation flows 12 is properly adjusted, the ink jet recording head can reduce the difference of the flow rates of the ink circulation flows 12 flowing in each pressure chamber 5 due to the differences of the positions of the pressure chambers 5.

A fifth exemplary embodiment of the present invention will be described below with reference to FIG. 8.

Figure 8:
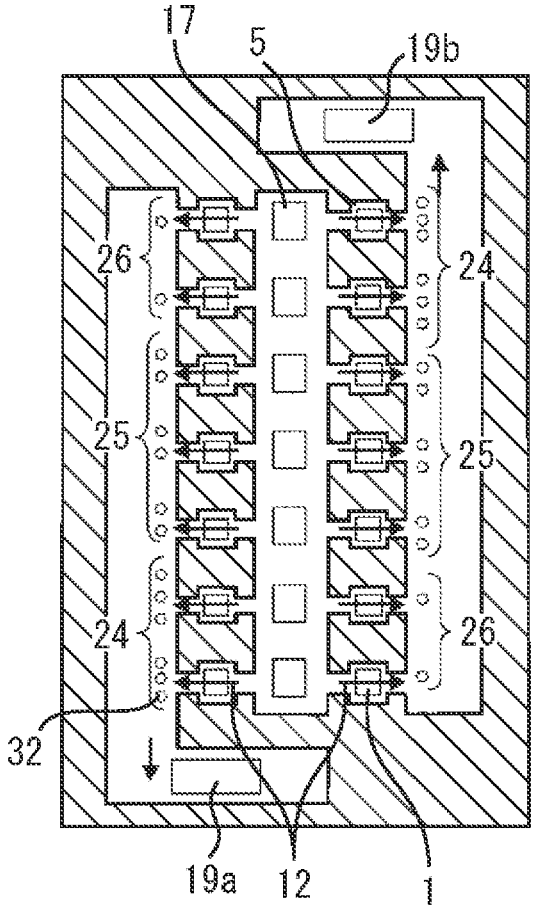
FIG. 8 is a schematic diagram illustrating a horizontal cross section of a main part of a fifth exemplary embodiment of an ink jet recording head according to the present invention.
Figure 9:
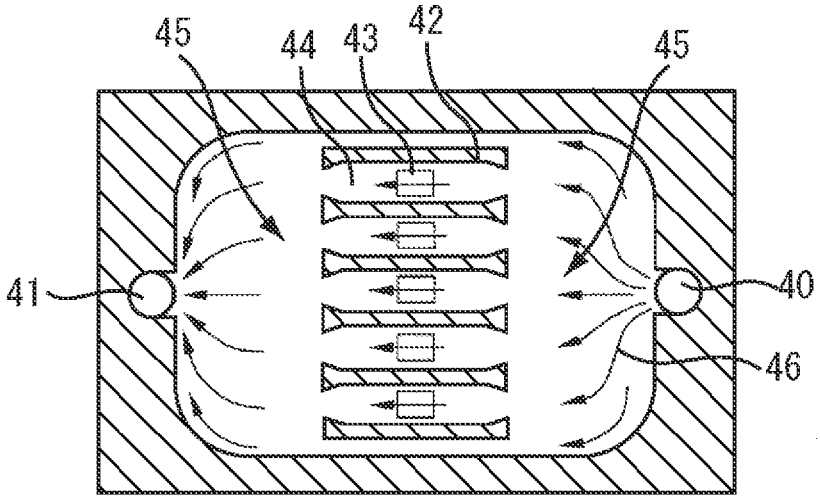
FIG. 9 is a schematic diagram illustrating a horizontal cross section of a main part of a conventional technique.

FIG. 8 is a schematic configuration diagram illustrating a main part of an ink jet recording head according to the fifth exemplary embodiment of the present invention. A fundamental configuration illustrated in FIG. 8 is similar to that of the above described third exemplary embodiment. Thus, detailed descriptions thereof will be omitted, and only different points will be described.

As illustrated in FIG. 8, the configuration of the fifth exemplary embodiment includes the pressure chambers 5 which are linearly arranged in two rows and hole shaped ink supply ports 17 which are provided on a side of the rows of the pressure chambers 5 at a position corresponding to each pressure chamber 5. In order to equalize a flow rate of the ink circulation flow 12 flowing in each pressure chamber 5 regardless of difference of a position in the row of each pressure chamber 5, a resistance element 32 is arranged between the pressure chambers 5 and the ink supply ports 17 which is not sandwiched between the rows of the pressure chambers 5. The resistance element 32 generates resistance for blocking a flow of the ink circulation flow 12. For example, the resistance element 32 can have a filter structure for preventing entrance of foreign substances. An amount of resistance generated by the resistance element 32 can be changed by adjusting numbers or sizes of the resistance element 32.

Further, the ink outlet ports 19 are provided at a pair of diagonal corners of the substrate 10. The other configurations are similar to that of the third exemplary embodiment (illustrated in FIGS. 6A to 6C).

The resistance element 32 in the fifth exemplary embodiment will be described in more detail using the following examples.

The ink jet recording head includes the pressure chambers 5 arranged in two rows at pitches of 600 dpi and the ink supply ports 17 which are arranged in one row and opened so as to be sandwiched between the rows of the pressure chambers 5. Opening shapes of the ink supply ports 17 have a square of 30 μm of each side. As the resistance element 32, columnar filter structures are provided on the sides of the pressure chambers 5 and between the pressure chambers 5 and the ink supply ports 17 which are not sandwiched between the rows of the pressure chambers 5. A number of the filter structures changes according to the positions in the row of the pressure chambers 5. The resistance elements 32 are extended on a surface of the substrate 10 on which the discharge port is provided. Three columnar filter structures of ϕ10 μm are provided in a pressure chamber group 24 at a position near the ink outlet ports 19*a* and 19*b*. One columnar filter structure of ϕ10 μm is provided in a pressure chamber group 26 at a position far from the ink outlet ports 19*a* and 19*b*. Two columnar filter structures of ϕ10 μm are provided in a pressure chamber group 25 between the groups 24 and 26.

According to such a configuration, the ink circulation flow 12 flowing in the pressure chambers 5 near the ink outlet ports 19*a* and 19*b* becomes hard to flow, and the ink circulation flow 12 flowing in the pressure chambers 5 far from the ink outlet ports 19*a* and 19*b* becomes easy to flow. Therefore, the ink circulation flow 12 which flows in each pressure chamber 5 at an approximately uniform flow rate can be generated.

If the difference of the fluid resistance is properly adjusted using the resistance elements 32, the ink jet recording head can reduce the difference of the flow rates of the ink circulation flows 12 flowing in each pressure chamber 5 due to the differences of the positions of the pressure chambers 5.

In the present invention, the ink jet recording head can generates the ink circulation flow 12 in each chamber 5 without extending and thickening the partition walls 16 forming the pressure chambers 5 like a conventional techniques. Further, even when the multiple rows of the pressure chambers 5 are provided, the similar effects can be obtained. Furthermore, it is not necessary to arrange the ink inlet port 18 and the ink outlet port 19 apart from each chamber 5. Therefore, the size of the ink jet recording head can be reduced comparing with the conventional ink jet recording head. Furthermore, since the flow rate of the ink circulation flow 12 flowing in each pressure chamber 5 can be approximated more uniform rate, the color unevenness of ink can be further reduced comparing with the conventional technique. Furthermore, since the structure of the ink jet recording head does not become complicated greatly, a production cost does not increase greatly.

The shape of the ink supply port 17 can be a long slit shape (long hole shape) or a plurality of holes formed by dividing a slit at a position corresponding to each chamber 5. The shape of the hole can be a square or a circle, and is not limited to a specific shape.

A recording apparatus in which the ink jet recording head of the present invention is installed can be a single function printer which includes only a recording function or a multi-function printer which includes a plurality of functions such as a printer, a facsimile, and a scanner. Further, the ink jet recording head according to the present invention can be installed in a manufacturing apparatus for manufacturing a color filter, an electronic device, and an optical device by ink jet recording.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-033894 filed Feb. 17, 2009, which is hereby incorporated by reference herein in its entirety.

What is claimed is:

1. A liquid jet recording head comprising:

a plurality of liquid discharge ports for discharging a liquid;

a plurality of pressure chambers which internally include a discharge energy generating element configured to generate energy used for discharging the liquid;

a substrate which has the discharge energy generating element on one surface side and, on another surface side, has a liquid chamber configured to store a liquid to be supplied to the pressure chamber, a pair of paths which are separated from the liquid chamber and communicate with each other, and a liquid supply port which communicates with the liquid chamber and is provided on a side of the pressure chamber, wherein a liquid inlet port which communicates with the one path of the pair of paths, and a liquid outlet port which communicates with the other path of the pair of paths are opened on the one surface of the substrate, wherein the liquid supply port is provided as at least two holes formed along the row of the plurality of the pressure chambers;

a liquid flow path for discharging the liquid from the liquid chamber to the pressure chamber via the liquid supply port; and a liquid flow path for circulating the liquid without passing through the liquid chamber from the one path to each of the pressure chambers via the liquid inlet port, and further circulating the liquid from each of the pressure chambers to the other path via the liquid outlet port, wherein an opening area of each of the at least two liquid supply ports configuring the liquid supply port row becomes larger in order of an increasing distance from the liquid outlet port.

2. The liquid jet recording head according to claim 1, wherein the liquid supply ports are arranged adjacent the plurality of linearly arranged pressure chambers, and the liquid inlet port and the liquid outlet port are placed near a pair of diagonal corners of the substrate.

3. The liquid jet recording head according to claim 1, wherein the one path and the other path are connected to each other via a pressure control unit which is provided outside the substrate.

4. The liquid jet recording head according to claim 1, wherein the liquid supply port has a slit shape extending along a row of the plurality of the pressure chambers.

5. The liquid jet recording head according to claim 1, wherein, in a plurality of rows of the pressure chambers which are formed by arranging the plurality of the pressure chambers, resistance elements for blocking a flow of the liquid are provided at a side of the plurality of the pressure chambers configuring the row of the pressure chambers on the liquid outlet port side, and fluid resistance of the resistance elements becomes larger in order of decreasing distance from the liquid outlet port.

6. A recording apparatus comprising:

the liquid jet recording head according to claim 1; and a pressure control unit which communicates with the one path and the other path.

7. A method for supplying a liquid comprising:

using a liquid jet recording head that includes:

a plurality of liquid discharge ports for discharging a liquid;

a plurality of pressure chambers which internally include a discharge energy generating element configured to generate energy used for discharging the liquid; and a substrate which has the discharge energy generating element on one surface side and, on another surface side, has a liquid chamber configured to store a liquid to be supplied to the pressure chamber, a pair of paths which are separated from the liquid chamber and communicate with each other, and a liquid supply port which communicates with the liquid chamber and is provided on a side of the pressure chamber, wherein a liquid inlet port which communicates with the one path of the pair of paths and a liquid outlet port which communicates with the other path of the pair of paths is opened on the one surface of the substrate, wherein the liquid supply port is provided as at least two holes formed along the row of the plurality of the pressure chambers; and supplying the liquid without passing through the liquid chamber from the one path to each of the pressure chambers via the liquid inlet port, and further from each of the pressure chambers to the other path via the liquid outlet port, wherein an opening area of each of the liquid supply ports configuring the liquid supply port row becomes larger in order of an increasing distance from the liquid outlet port.

* * * * *